US007254909B2

(12) United States Patent
Ungari

(10) Patent No.: US 7,254,909 B2
(45) Date of Patent: Aug. 14, 2007

(54) ARTICLE OF FOOTWEAR WITH RETRACTABLE PROTRUSION

(75) Inventor: Joseph L. Ungari, Hillsboro, OR (US)

(73) Assignee: Nike, Inc., Beaverton, OR (US)

( * ) Notice: Subject to any disclaimer, the term of this patent is extended or adjusted under 35 U.S.C. 154(b) by 460 days.

(21) Appl. No.: 10/897,054

(22) Filed: Jul. 22, 2004

(65) Prior Publication Data

US 2006/0016101 A1 Jan. 26, 2006

(51) Int. Cl.
*A43C 15/00* (2006.01)

(52) U.S. Cl. ..... 36/61; 36/29

(58) Field of Classification Search ..... 36/61, 36/59 R, 29, 134
See application file for complete search history.

(56) References Cited

U.S. PATENT DOCUMENTS

| | | | | | |
|---|---|---|---|---|---|
| 1,361,078 | A | | 12/1920 | Lynn | |
| 1,607,296 | A | * | 11/1926 | Noel | 36/61 |
| 1,771,258 | A | * | 7/1930 | Kalikow et al. | 439/37 |
| 2,095,095 | A | * | 10/1937 | Howard | 36/59 R |
| 2,303,744 | A | * | 12/1942 | Jacobs | 36/29 |
| 4,271,608 | A | | 6/1981 | Tomuro | 36/61 |
| 4,375,729 | A | | 3/1983 | Buchanen, III | 36/61 |
| 4,402,145 | A | * | 9/1983 | Dassler | 36/32 R |
| 4,407,079 | A | * | 10/1983 | Chiroff | 36/127 |
| 4,561,197 | A | | 12/1985 | Misevich | 36/127 |
| 4,715,133 | A | | 12/1987 | Hartjes et al. | 36/127 |
| 4,748,753 | A | * | 6/1988 | Ju | 36/127 |
| 4,821,434 | A | | 4/1989 | Chein | 36/134 |
| 4,873,774 | A | * | 10/1989 | Lafever | 36/61 |
| 5,289,647 | A | | 3/1994 | Mercer | 36/134 |
| 5,299,369 | A | * | 4/1994 | Goldman | 36/61 |
| 5,526,589 | A | * | 6/1996 | Jordan | 36/134 |
| 5,740,619 | A | * | 4/1998 | Broder | 36/61 |
| 6,125,556 | A | | 10/2000 | Peckler et al. | 36/127 |
| 6,266,897 | B1 | | 7/2001 | Seydel et al. | 36/29 |
| 6,516,540 | B2 | | 2/2003 | Seydel et al. | 36/29 |
| 6,550,160 | B2 | * | 4/2003 | Miller, II | 36/127 |
| 6,698,110 | B1 | * | 3/2004 | Robbins | 36/61 |

* cited by examiner

*Primary Examiner*—Marie Patterson
(74) *Attorney, Agent, or Firm*—Banner & Witcoff, Ltd.

(57) ABSTRACT

An article of footwear includes an upper and a sole assembly secured to the upper. At least one recess is formed in the sole assembly, and a retractable protrusion is positioned in each recess. The protrusion is configured to be contained substantially within an exterior surface of the sole assembly in a retracted position and to extend substantially beyond the exterior surface in an extended position. The footwear includes at least one reservoir containing a fluid, with each reservoir having a first chamber and a second chamber. The first and second chambers are in fluid communication with one another, the first chamber is positioned inwardly of the second chamber, and the second chamber is positioned proximate a retractable protrusion.

24 Claims, 5 Drawing Sheets

ARTICLE OF FOOTWEAR WITH RETRACTABLE PROTRUSION

FIELD OF THE INVENTION

This invention relates generally to an article of footwear and, in particular, to an article of footwear having a retractable protrusion.

BACKGROUND OF THE INVENTION

Athletes in many sports, including, for example, football, soccer, and lacrosse, use cleated footwear. Conventional cleated athletic footwear includes two primary elements, an upper and a sole. The upper is often formed of leather, synthetic materials, or a combination thereof, and comfortably secures the footwear to the foot, while providing ventilation and protection from the elements. The sole forms the ground-contacting element of footwear and is usually fashioned from a durable, wear resistant material that includes a plurality of cleats. The cleats extend from a lower surface of the sole and serve to engage the ground, thereby increasing traction for the user. Often times, the cleats are formed of one-piece construction with the sole. Alternatively, the cleats are removably secured to the sole, such as by a threaded member extending from the cleat that is received by a threaded member in the sole. In either case, the cleats are fixed with respect to the rest of the shoe when in use and extend outwardly from the sole at all times.

Other footwear is used in circumstances where additional support would be desirable. For example, certain footwear used in sports where quick lateral movements are often required, such as basketball, tennis and other court-based games. Such footwear would benefit from increased support on lateral and medial edges of the footwear.

It is an object of the present invention to provide an article of footwear having a retractable protrusion, e.g., a cleat or support member, that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide an article of footwear with one or more retractable protrusions, providing momentary aggressive traction and/or support for the user's foot in a desired area of the article of footwear.

In accordance with a first aspect, an article of footwear includes an upper and a sole assembly secured to the upper. At least one recess is formed in the sole assembly, and a retractable protrusion is positioned in each recess. The protrusion is configured to be contained substantially within an exterior surface of the sole assembly in a retracted position and to extend substantially beyond the exterior surface in an extended position. The footwear includes at least one reservoir containing a fluid, with each reservoir having a first chamber and a second chamber. The first and second chambers are in fluid communication with one another, the first chamber is positioned inwardly of the second chamber, and the second chamber is positioned proximate a retractable protrusion.

In accordance with another aspect, an article of footwear includes a sole assembly comprising a midsole and an outsole. An upper is secured to the sole assembly. A plurality of recesses is formed in the sole assembly, with each recess extending through the outsole and partially into the midsole. The footwear includes a plurality of retractable protrusions. Each protrusion is positioned in a corresponding recess and configured to be contained substantially within an exterior surface of the outsole in a retracted position and to extend substantially beyond the exterior surface of the outsole in an extended position. A plurality of reservoirs is positioned in the midsole, with each reservoir containing a fluid and having a first chamber and a second chamber. Each first chamber is in fluid communication with a corresponding second chamber and is positioned in the midsole. Each second chamber is positioned proximate a corresponding retractable protrusion.

In accordance with a further aspect, an article of footwear includes an upper and a sole assembly secured to the upper. At least one recess is formed in the sole assembly. At least one retractable protrusion is provided in the sole assembly. Each protrusion is positioned in a recess and is configured to be contained substantially within the sole assembly in a retracted position and to extend substantially beyond an exterior surface of the sole assembly in an extended position. At least one reservoir containing a fluid is positioned proximate a retractable protrusion.

Substantial advantage is achieved by providing an article of footwear having a retractable protrusion. For example, an article of footwear having a retractable cleat allows the user to have a shoe with standard traction under certain conditions, and additional traction from an extended cleat in circumstances and in a location where such additional traction would be advantageous.

Similarly, an article of footwear with a retractable protrusion may provide on-demand support in a desired area of the shoe, increasing stability for the user when needed during movements such as a lateral cutting move.

These and additional features and advantages of the invention disclosed here will be further understood from the following detailed disclosure of certain preferred embodiments.

Figure 1:
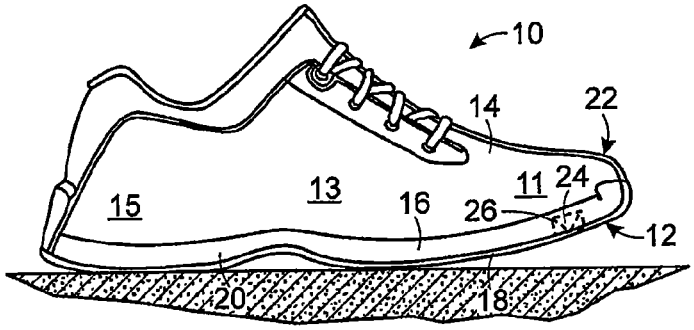
FIG. 1 is an elevation view of an article of footwear with a retractable protrusion in accordance with a preferred embodiment of the present invention, shown with the protrusion in a retracted position.

The figures referred to above are not drawn necessarily to scale and should be understood to provide a representation of the invention, illustrative of the principles involved. Some features of the article of footwear with a retractable protrusion depicted in the drawings have been enlarged or distorted relative to others to facilitate explanation and understanding. The same reference numbers are used in the drawings for similar or identical components and features shown in various alternative embodiments. Articles of footwear with a retractable protrusion as disclosed herein would have configurations and components determined, in part, by the intended application and environment in which they are used.

DETAILED DESCRIPTION OF CERTAIN PREFERRED EMBODIMENTS

The present invention may be embodied in various forms. The following discussion and accompanying figures disclose an article of footwear 10 in accordance with the present invention. Footwear 10 may be any style of footwear including, for example, footwear that typically includes cleats such as soccer cleats, football cleats, and golf shoes. However, footwear 10 is not to be restricted to types of footwear known to have cleats. Footwear 10 could also be any style of footwear that could accommodate a retractable protrusion for additional traction and/or support in certain circumstances, such as a basketball shoe, a tennis shoe, a climbing shoe or a running shoe.

Figure 2:
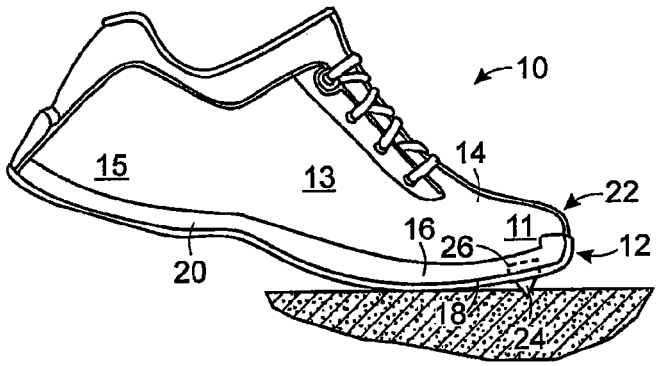
FIG. 2 is an elevation view of the article of footwear of FIG. 1, shown as toe-off begins and with the retractable protrusion starting to extend outwardly from the footwear.
Figure 3:
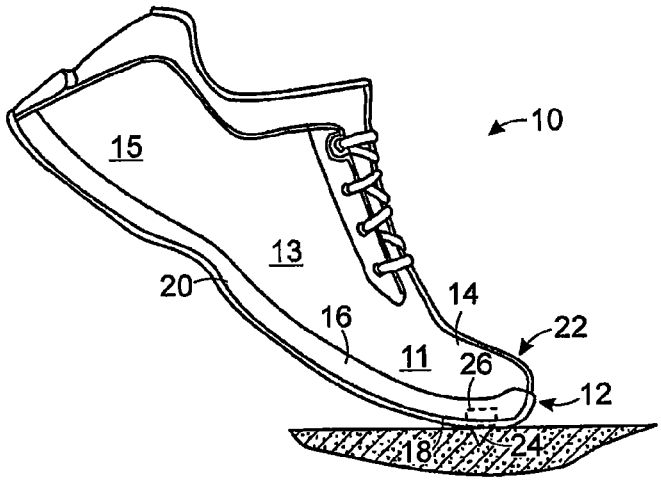
FIG. 3 is an elevation view of the article of footwear of FIG. 1, shown as toe-off is near completion and with the retractable protrusion fully extended.

A preferred embodiment of an article of footwear 10 is shown in FIGS. 1-3. Footwear 10 includes a sole assembly 12 and an upper 14 secured to sole assembly 12. Upper 14 forms an interior void that comfortably receives a foot and secures the position of the user's foot relative to sole assembly 12. The configuration of upper 14, as depicted, is suitable for use during athletic activities. Accordingly, upper 14 may have a lightweight, breathable construction that includes multiple layers of leather, textile, polymer, and foam elements adhesively bonded and stitched together. For example, upper 14 may have an exterior that includes leather elements and textile elements for resisting abrasion and providing breathability, respectively. The interior of upper 14 may have foam elements for enhancing the comfort of footwear 10, and the interior surface may include a moisture-wicking textile for removing excess moisture from the area immediately surrounding the foot.

For purposes of general reference, footwear 10 may be divided into three general portions: a forefoot portion 11, a midfoot portion 13, and a heel portion 15. Portions 11, 13, and 15 are not intended to demarcate precise areas of footwear 10. Rather, portions 11, 13, and 15 are intended to represent general areas of footwear 10 that provide a frame of reference during the following discussion.

Figure 4:
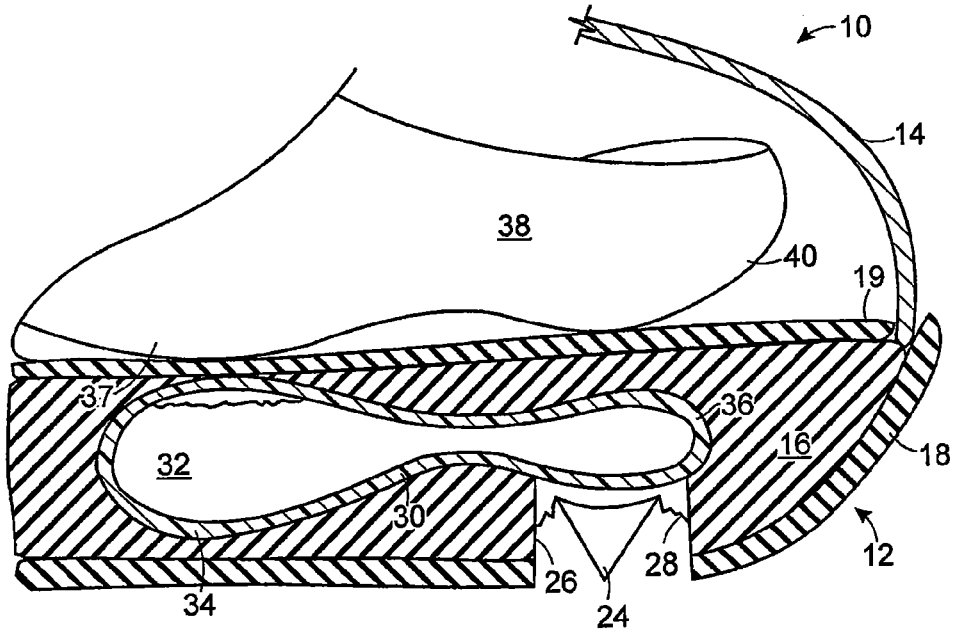
FIG. 4 is a section view of the forefoot portion of the article of footwear of FIG. 1, shown with the retractable protrusion in its retracted condition.

Sole assembly 12 includes a midsole 16 to which upper 14 is secured, and an outsole 18, which may include a tread pattern (not shown) for added traction. An insole 19, as seen in FIG. 4, may be positioned within upper 14 above midsole 16. Footwear 10 has a medial, or inner, side 20 and a lateral, or outer, side 22. Although sides 20, 22 apply generally to footwear 10, references to sides 20, 22 may also apply specifically to upper 14, sole assembly 12, or any other individual component of footwear 10.

Unless otherwise stated, or otherwise clear from the context below, directional terms used herein, such as rear, rearwardly, front, forwardly, inwardly, outwardly, lower, downwardly, upper, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 15, that is, to the left as seen in FIG. 1. Naturally, forwardly is toward forefoot portion 11, that is, to the right as seen in FIG. 1, downwardly and lower are toward the bottom of the page as seen in FIG. 1, and upwardly is toward the top of the page as seen in FIG. 1. Inwardly is toward the center of footwear 10, and outwardly is toward the outer periphery of footwear 10.

Footwear 10 includes one or more protrusions that are retractable with respect to footwear 10. The protrusions can be located in any desired area of the footwear, and can provide increased traction and/or support. As described in greater detail below, pressure caused by movement of the user's foot causes the protrusion to extend from footwear 10. Once the pressure is released, the protrusion retracts.

As seen in a preferred embodiment in FIGS. 1-3, footwear 10 has a protrusion in the form of a cleat 24, which provides increased traction. In the illustrated embodiment, cleat 24 is received in a recess 26 formed in sole assembly 12. As shown in FIG. 1, cleat 24 is in a first condition in which cleat 24 is in a static or at-rest position. In the first condition, cleat 24 is retracted into sole assembly 12 and provides no traction for the user. In a preferred embodiment, an outermost edge of cleat 24 is substantially flush with the exterior surface of outsole 18 in the first condition.

As the user's foot starts to move toward the toe off position, cleat 24 begins to extend outwardly from sole assembly 12, as seen in FIG. 2 and described in greater detail below. At toe off, as seen in FIG. 3, cleat 24 is fully extended in a second or activated condition such that a substantial portion of cleat 24 extends beyond the lower or exterior surface of sole assembly 12. The extension of cleat 24 in the second position provides additional traction in forefoot portion 11 of footwear 10.

Footwear 10 is shown in the embodiment illustrated in FIGS. 1-3 with a single cleat in forefoot portion 11, and without cleats in midfoot portion 13 and heel portion 15. In certain preferred embodiments, a plurality of cleats may be provided in forefoot portion 11. Additionally, it is to be appreciated that other areas of footwear 10, including the midfoot 13 and heel portions 15, may include one or more additional cleats, which may be retractable or fixed cleats. The number and location of cleats throughout footwear 10 can vary, and suitable numbers and locations will become readily apparent to those skilled in the art, given the benefit of this disclosure.

Figure 5:
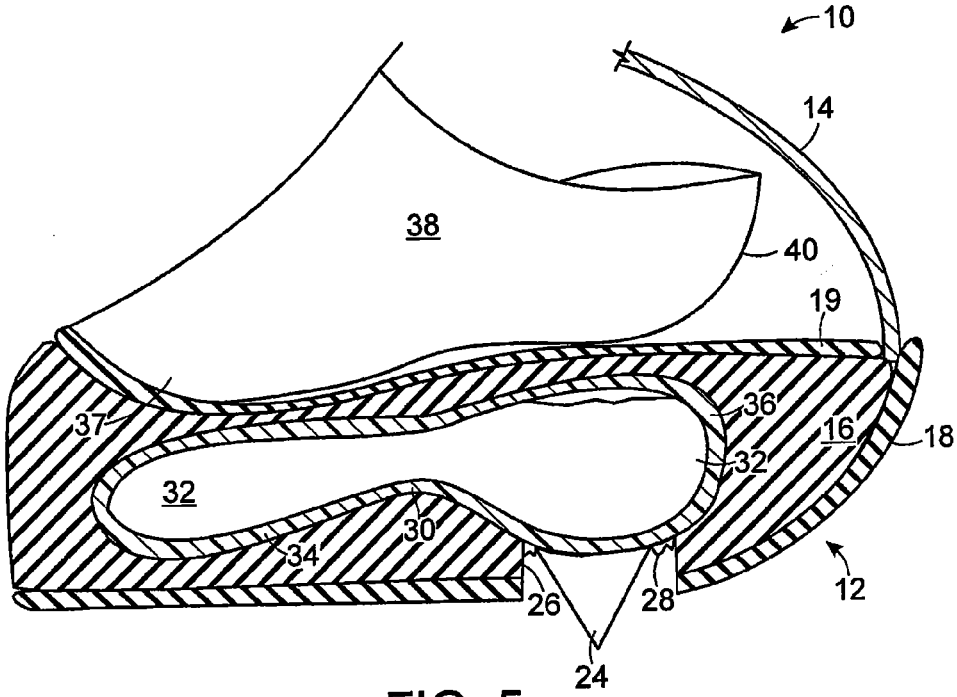
FIG. 5 is a section view of the forefoot portion of the article of footwear of FIG. 1, shown with the retractable protrusion in its extended condition.

The operation of retractable cleat 24 can be seen in greater detail in FIGS. 4-5. In this preferred embodiment, recess 26 extends through outsole 18 and partially into midsole 16. A seal 28 is secured to and extends between recess 26 and cleat 24. Seal 28 provides a barrier to prevent moisture, dirt and other contaminants from entering footwear 10 through recess 26. Seal 28 may be formed of any suitable resilient, flexible material such as rubber, textile, or a thermoplastic material.

A reservoir 30 is positioned in sole assembly 12 and contains a fluid 32. At least a portion of reservoir 30 is positioned above cleat 24. In a preferred embodiment, reservoir 30 is formed of a first chamber 34 and a second chamber 36 that is in fluid communication with first chamber 34. First chamber 34 is aligned with the metatarsal head portion 37 of foot 38 of the user and second chamber 36 is aligned with the big toe 40 of the user. Second chamber 36 is adjacent an upper surface of cleat 24.

In a preferred embodiment, first chamber 34 has a volume that is larger than a volume of second chamber 36 and, therefore, holds more of fluid 32 when reservoir 30 is in the at-rest first condition. When pressure is applied to first chamber 34 of reservoir 30 upon impact by the metatarsal portion 37 of the user's foot 38, as seen in FIG. 5, first chamber 34 compresses, forcing more fluid 32 into second chamber 36. Second chamber naturally expands and forces cleat 24 out downwardly beyond the exterior surface of outsole 18 providing additional traction in forefoot portion 11 of footwear 10.

This application of pressure on the metatarsal head 37 occurs as the user's stride approaches toe off. As the heel portion 15 of the user's foot lifts upwardly as the user strides forward, increased pressure is placed on metatarsal head portion 37 and cleat 24 is forced outwardly prior to toe off. Consequently, cleat 24 is fully extended when the user's foot gets to the toe off position and provides additional traction in the region of the user's toes. Once the pressure from the user's foot is released from first chamber 34, reservoir 30 reverts to its original condition and cleat 24 is free to retract back into sole assembly 12.

Figure 12:
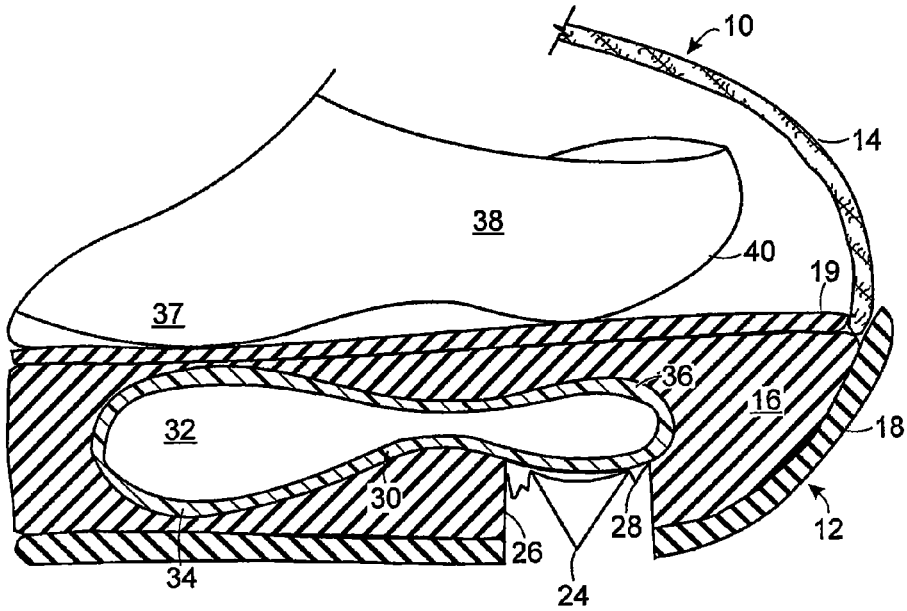
FIG. 12 is a section view of the forefoot portion of an alternative embodiment of the article of footwear of FIG. 1, shown with the retractable protrusion in its retracted condition.

In another preferred embodiment, as illustrated in FIG. 12, cleat 24 is secured directly to a lower surface of second chamber 36. Cleat 24 may be secured to second chamber 36 by a suitable adhesive, for example. In such an embodiment, cleat 24 is positively drawn back within sole assembly 12 when reservoir 30 reverts to its original condition.

Figure 6:
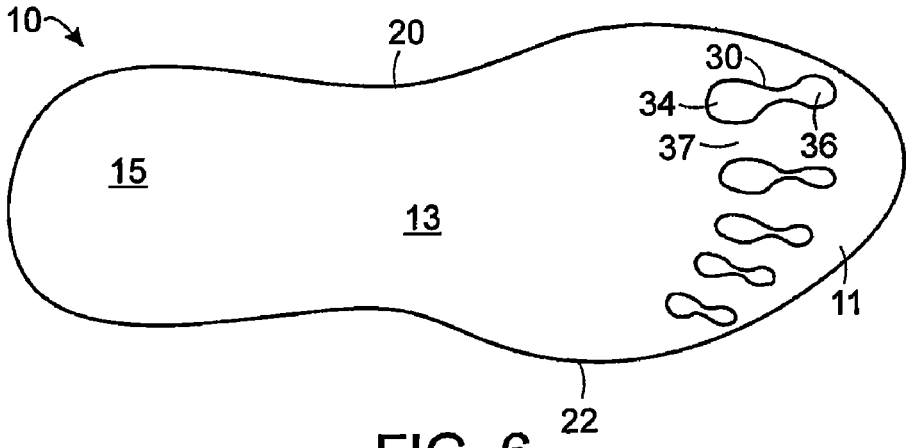
FIG. 6 is a schematic plan view of an alternative embodiment of the present invention, showing reservoirs for five retractable protrusions positioned in the midsole of the article of footwear.

It is to be appreciated that one or more cleats 24 and corresponding reservoirs 30 may be provided in footwear 10. In certain preferred embodiments, a cleat 24 is positioned beneath each of the user's toes, as schematically illustrated in FIG. 6 where footwear 10 has five reservoirs 30. Each of reservoirs 30 is positioned above a corresponding cleat 24.

Figure 7:
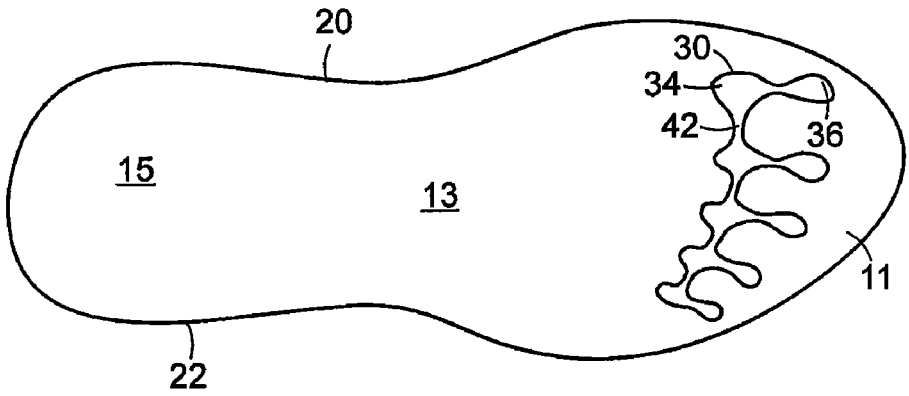
FIG. 7 is a schematic plan view of another alternative embodiment of the present invention, showing reservoirs for five retractable protrusions positioned in the midsole of the article of footwear, the five reservoirs being in fluid communication with one another.

In certain preferred embodiments, as seen in FIG. 7, reservoirs 30 may be in fluid communication with each other. As illustrated here, channels 42 are provided between adjacent reservoirs 30, allowing fluid 32 to flow between each of the first chambers 32 and from first chambers 32 into corresponding second chambers 34.

Reservoir 30 is preferably formed of a flexible, resilient material such as any thermoplastic material, e.g., thermoplastic urethane (TPU). Cleats 24 may be formed of a hard material such as plastic, e.g., nylon, hard rubber, or a thermoplastic material. Fluid 30 may be water, air, or any other suitable fluid. Other suitable materials for reservoir 30, cleat 24 and fluid 30 will become readily apparent to those skilled in the art, given the benefit of this disclosure.

Figure 8:
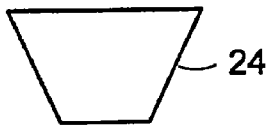
FIG. 8 is an elevation view of an alternative embodiment of a retractable protrusion of the article of footwear of FIG. 1.

In the embodiment illustrated in FIGS. 1-2, cleat 24 is seen to have a conical shape. It is to be appreciated that cleat 24 can have any desired shape. Another exemplary shape for cleat 24 is seen in FIG. 8, in which cleat 24 has a frusto-conical shape. Other suitable shapes for cleat 24 will become readily apparent to those skilled in the art, given the benefit of this disclosure.

Figure 9:
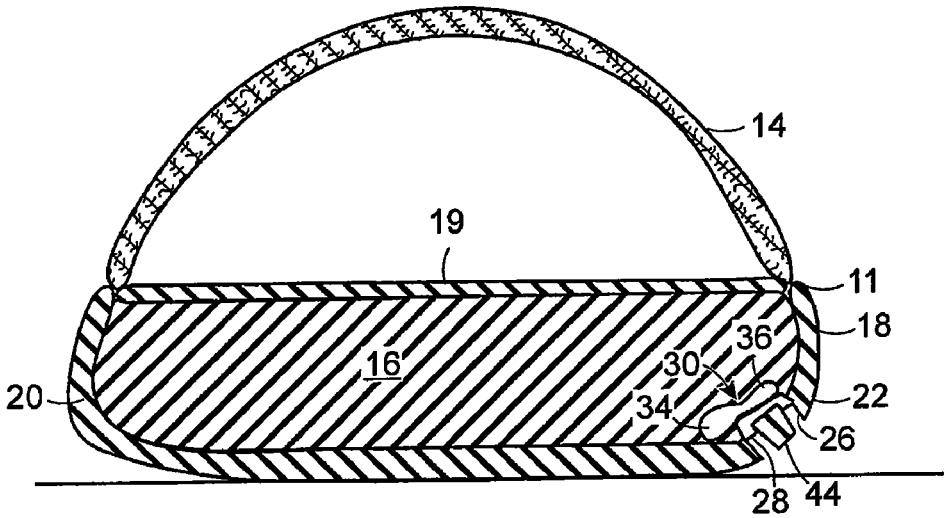
FIG. 9 is a section view of the forefoot portion of an alternative embodiment of an article of footwear of the present invention, shown with a retractable protrusion in a lateral sidewall of the article of footwear and in its retracted condition.
Figure 10:
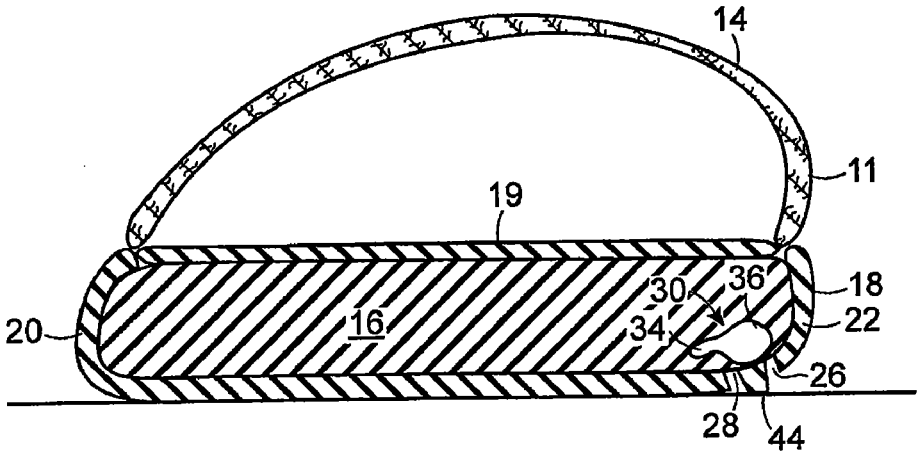
FIG. 10 is a section view of the forefoot portion of the article of footwear of FIG. 9, shown with the retractable protrusion in its extended condition.

As noted above, protrusions can be provided in many different locations in footwear 10. Another preferred embodiment is illustrated in FIGS. 9-10 in which a retractable protrusion in the form of a support member 44 is positioned in a recess 26 formed in a side of sole assembly 12. Support member 44 extends along a length of a side of footwear 10. As illustrated here, support member 44 extends along the lateral side 22 of forefoot portion 11 of footwear 10. A support member 44 may also be provided along the medial side of forefoot portion 11. Similarly, a support member may be provided along the lateral or medial side of heel portion 15 or midfoot portion 13. It is to be appreciated that more than one support member may be provided along lateral side 22, medial side 20 or along both sides.

As illustrated in FIGS. 9-10, a reservoir 30 is positioned such that first chamber 34 is positioned inwardly of second chamber 36, and second chamber 36 is proximate retractable support member 44. The article of footwear shown in this embodiment will naturally provide additional support along lateral side 22 when a user's foot moves quickly to the lateral side 22 of footwear 10, such as when a basketball or tennis player moves quickly to their lateral side. Accordingly, it can be appreciated that retractable support members 44 in other areas of footwear 10 can provide temporary additional support for different types of foot movements.

Figure 11:
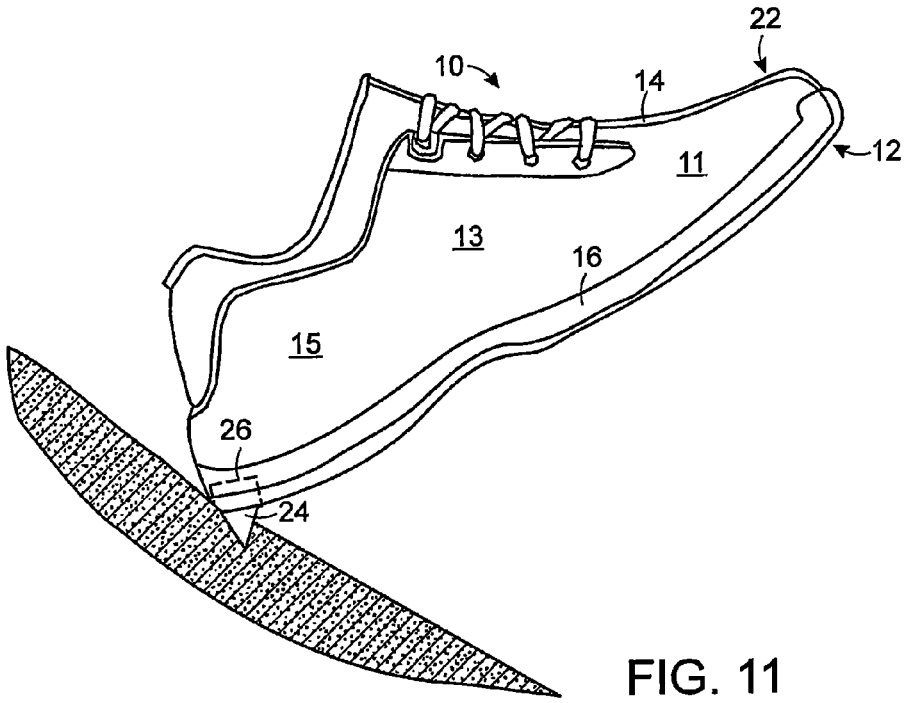
FIG. 11 is an elevation view of another preferred embodiment of the present invention, in which a retractable protrusion is provided in a heel portion, the cleat being shown during heel strike in an extended position.

Another preferred embodiment is seen in FIG. 11, in which a retractable cleat 24 is provided in heel portion 15 of footwear 10. By positioning a retractable cleat in heel portion 14, a user is provided with additional traction and stability when descending steep grades, such as when hiking or mountain climbing. In this embodiment, it is the heel strike action of the user's heel as they descend that compresses the reservoir 30 (not shown here for clarity purposes), and causes cleat 24 to extend outwardly from outsole 18. Subsequent release of the heel strike pressure allows cleat 24 to retract.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. An article of footwear comprising, in combination:

an upper;

a sole assembly secured to the upper;

at least one recess formed in the sole assembly;

at least one retractable protrusion, each protrusion positioned in a recess and configured to be contained substantially within the sole assembly in a retracted position and to extend substantially beyond an exterior surface of the sole assembly in an extended position; and at least one reservoir containing a fluid, each reservoir having a first chamber and a second chamber, the first and second chambers being in fluid communication with one another, the first chamber positioned inwardly of the second chamber and the second chamber positioned proximate a corresponding retractable protrusion;

wherein compression of each reservoir from pressure from a user's foot causes the corresponding protrusion to extend to its extended position.

2. The article of footwear of claim 1, wherein the sole assembly comprises an outsole and a midsole secured to the outsole.

3. The article of footwear of claim 1, wherein each first chamber is positioned at a metatarsal head portion of the sole assembly and each second chamber is positioned to be beneath a toe of a user.

4. The article of footwear of claim 1, wherein the sole assembly includes five recesses with each recess positioned to be beneath a toe of a user, a protrusion being positioned in each of the five recesses.

5. The article of footwear of claim 4, wherein each protrusion is a cleat.

6. The article of footwear of claim 1, further comprising at least one seal, each seal connected at an outer edge thereof to a corresponding recess and at an inner edge thereof to a corresponding retractable protrusion.

7. The article of footwear of claim 6, wherein each seal is formed of a thermoplastic material.

8. The article of footwear of claim 1, wherein an outermost surface of each retractable protrusion is substantially flush with an exterior surface of the sole assembly in the retracted position.

9. The article of footwear of claim 1, wherein each reservoir is formed of a polymer.

10. The article of footwear of claim 1, wherein each reservoir is formed of a thermoplastic material.

11. The article of footwear of claim 1, wherein each reservoir contains air.

12. The article of footwear of claim 1, wherein one protrusion is a support member extending along a lateral edge of the sole assembly.

13. The article of footwear of claim 1, wherein one protrusion is a support member extending along a lateral edge of a forefoot portion of the sole assembly.

14. The article of footwear of claim 1, wherein one protrusion is a support member extending along a lateral edge of a midfoot portion of the sole assembly.

15. The article of footwear of claim 1, wherein one protrusion is a support member extending along a lateral edge of a heel portion of the sole assembly.

16. The article of footwear of claim 1, wherein one protrusion is a support member extending along a medial edge of the sole assembly.

17. The article of footwear of claim 1, wherein one protrusion is a support member extending along a medial edge of a forefoot portion of the sole assembly.

18. The article of footwear of claim 1, wherein one protrusion is a support member extending along a medial edge of a midfoot portion of the sole assembly.

19. The article of footwear of claim 1, wherein one protrusion is a support member extending along a medial edge of a heel portion of the sole assembly.

20. The article of footwear of claim 1, wherein one recess and one corresponding protrusion are formed proximate a rear edge of a heel portion of the sole assembly.

21. The article of footwear of claim 20, wherein the one protrusion is a cleat.

22. An article of footwear comprising, in combination:

a sole assembly comprising a midsole and an outsole;

an upper secured to the sole assembly;

a plurality of recesses formed in the sole assembly, each recess extending through the outsole and partially into the midsole;

a plurality of retractable protrusions, each protrusion positioned in a corresponding recess and configured to be contained substantially within an exterior surface of the outsole in a retracted position and to extend substantially beyond the exterior surface of the outsole in an extended position; and a plurality of reservoirs positioned in the midsole, each reservoir containing a fluid and having a first chamber and a second chamber, each first chamber being in fluid communication with a corresponding second chamber and being positioned in the midsole, each second chamber being positioned proximate a corresponding retractable protrusion;

wherein compression of each first chamber from pressure from a user's foot causes the corresponding protrusion to extend to its extended position.

23. An article of footwear comprising, in combination:

an upper;

a sole assembly secured to the upper;

at least one recess formed in the sole assembly;

at least one retractable protrusion, each protrusion positioned in a recess and configured to be contained substantially within the sole assembly in a retracted position and to extend substantially beyond an exterior surface of the sole assembly in an extended position; and at least one reservoir containing a fluid, each reservoir positioned proximate a corresponding retractable protrusion;

wherein compression of each reservoir from pressure from a user's foot causes the corresponding protrusion to extend to its extended position.

24. An article of footwear comprising, in combination:

an upper;

a sole assembly secured to the upper;

at least one recess formed in the sole assembly;

at least one retractable protrusion, each protrusion positioned in a recess and configured to be contained substantially within the sole assembly in a retracted position and to extend substantially beyond an exterior surface of the sole assembly in an extended position; and a plurality of reservoirs, each reservoir containing a fluid and having a first chamber and a second chamber, the first and second chambers being in fluid communication with one another, the first chamber positioned inwardly of the second chamber and the second chamber positioned proximate a retractable protrusion, a plurality of the first chambers positioned at a metatarsal head portion of the sole assembly, a plurality of the second chambers positioned to be beneath a toe of a user, a volume of the first chamber being larger than a volume of the second chamber.

* * * * *